United States Patent [19]

Courson et al.

[11] 4,095,358

[45] Jun. 20, 1978

[54] APPARATUS FOR HIGH-SPEED TRENCH DIGGING BESIDE HIGHWAYS

[75] Inventors: Thomas G. Courson, Mansfield; William L. Schlueter, Rantoul; Thomas T. Kelly, Champaign, all of Ill.

[73] Assignee: Central Illinois Tile Co., Champaign, Ill.

[21] Appl. No.: 765,808

[22] Filed: Feb. 4, 1977

[51] Int. Cl.[2] ..... E02F 5/06

[52] U.S. Cl. ..... 37/90

[58] Field of Search ..... 37/90, 89, 88, 87, 86, 37/84, 83

[56] References Cited

U.S. PATENT DOCUMENTS

| | | | |
|---|---|---|---|
| 673,920 | 5/1901 | McKee | 37/90 |
| 939,731 | 11/1909 | Miller | 37/86 UX |
| 1,073,227 | 9/1913 | Funk | 37/86 |
| 1,237,260 | 8/1917 | Bentson | 37/90 X |
| 1,237,310 | 8/1917 | Dobson | 37/90 |
| 1,689,981 | 10/1928 | Vaughn | 37/90 |
| 1,767,017 | 6/1930 | Scheckler | 37/86 |
| 2,231,983 | 2/1941 | Zuckerman | 37/86 |
| 2,669,792 | 2/1954 | Hein | 37/90 |
| 2,710,466 | 6/1955 | Chartier | 37/90 |
| 2,750,687 | 6/1956 | Banister | 37/90 |
| 2,859,544 | 11/1958 | Evans | 37/90 |
| 3,011,278 | 12/1961 | Lust | 37/86 X |
| 3,130,506 | 4/1964 | Laster | 37/86 |
| 3,201,948 | 8/1965 | Schramm | 37/86 X |
| 3,209,473 | 10/1965 | Davis | 37/90 |

*Primary Examiner*—Clifford D. Crowder

*Attorney, Agent, or Firm*—Wegner, Stellman, McCord, Wiles & Wood

[57] ABSTRACT

A structure for a high-speed chain trencher permitting entrapment of trenched soil and conveyance thereof to a lateral position away from the trench leaving a clean trench so that drainage tubing and compacted sand fill may be installed in the trench free of loose soil and without the necessity of additional trench preparation after passage of the trenching machine. The conditions of usage of the present invention are particularly useful in installing drainage beside highways for enhancing pavement life.

2 Claims, 3 Drawing Figures

Fig. 1
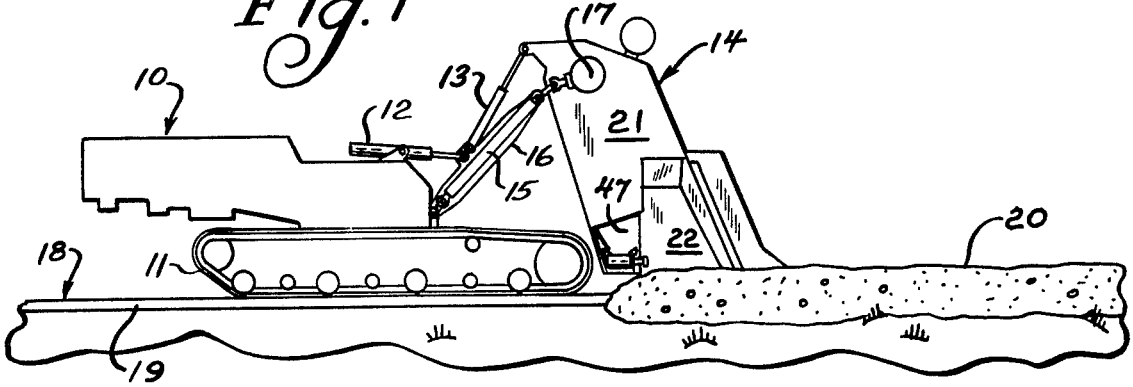
Fig. 2
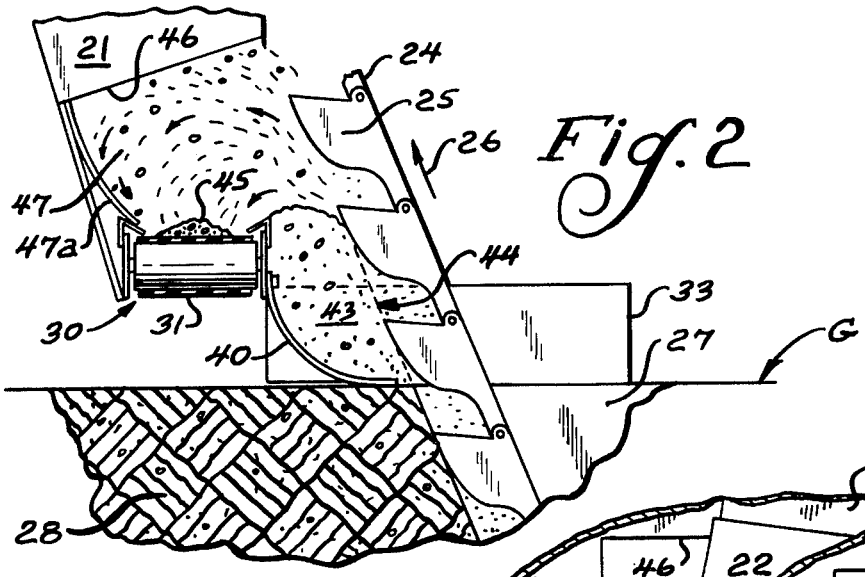
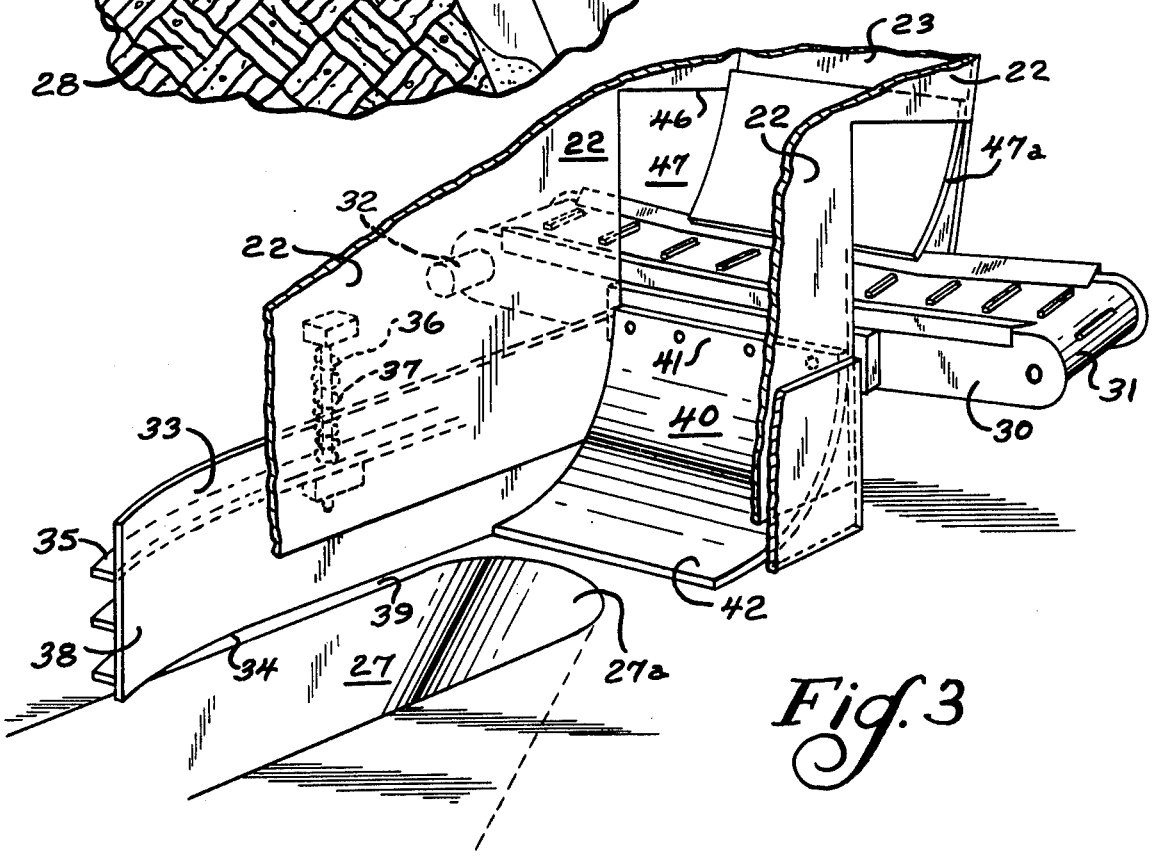
Fig. 3

APPARATUS FOR HIGH-SPEED TRENCH DIGGING BESIDE HIGHWAYS

BACKGROUND OF THE INVENTION

There has been recent data developed which indicates that the crushed stone, rock and gravel fills under concrete highways and asphalted shoulders have not performed as expected to rapidly disperse rainwater away from the highway and its base, but allow the accumulation of some water under concrete pavements, particularly at the edges thereof, resulting in earlier breakdown of the pavement than expected. As a result of these studies, it has been proposed to provide more adequate drainage, a type of drain which will receive rainwater shortly after it falls upon the pavement and highway and conducting the same rapidly away from the highways and its base materials to lateral ditches where the runoff will not affect the pavement. Some studies show that pavement life, such as utilized throughout the country on the interstate highway system, may have a prolonged life of 40 years compared to its present estimated 20-year life. Such adequate drainage can be provided by drainage tubing installed closely adjacent the lateral edges of the concrete slab to receive water which invariably tends to flow over the pavement and enter a seam between the concrete and the asphalt shoulder or berm. Such drainage tiling can be provided with laterals every 300 or so feet to exit collected water into side ditches. It has been found that during a rainstorm, 4 inch drainage tile, so installed, will flow an apparently solid stream of water into the ditches indicating rapid collection and conduction of rainwater away from under paving.

The cost of installing drainage tubing beside highways by conventionally known methods is excessively high. Where exceedingly long corrugated wall-perforated drainage tubing is installed immediately behind a chain trencher, such as disclosed in our copending application Ser. No. 728,556, filed Oct. 1, 1976, now U.S. Pat. No. 4,028,902, the ability to adequately compact sand over the tile free of loose soil may be accomplished. Other installations, however, require the mechanical joining of finite lengths, such as 10 foot long lengths, or "Orangeburg" pipe, which generally requires an installation at some distance rearward of the trenching operation to be followed by a sand fill and compaction over the so laid drainage tiling. In such instances, it is important that the trench left by the trenching machinery be free of loose dirt and that the ground surface on either side of the trench also be free of loose dirt or soil so that the drainage tubing may be installed and the sand compaction be placed thereover, free of loose soil.

It is to solve the problems of trenching with a high-speed chain trencher so as to form a trench beside a highway, substantially lowering the cost of so doing, while depositing loose soil away from the trench, leaving the trench in proper condition to receive drainage tiling and properly compacted sand fill thereover. Bearing in mind that vehicles which leave a highway slab and pass onto the shoulder will pass over the trench location, it is important that the trench be properly backfilled with the sand fill thereover properly compacted to sustain the weight of such vehicles. Heretofore, high-speed trenchers have not been thought to be operable to clean trench operation due to the throwing of removed soil so randomly about the excavation site.

SUMMARY OF THE INVENTION

It is the principal object of this invention to provide a structure for high-speed chain trenching capable of leaving a clean trench and clean ground surface on either side of a trench so dug.

Another object is to provide a structure permitting relatively rapid trenching with deposition of substantially all removed soil in a row laterally of and remote from the trench opening in the earth.

A further object is to provide means for temporarily extending the effectiveness of a chain trencher above ground level so that soil may be propelled by the chain cutters to a position substantially above ground for collection and subsequent deposition in a selected manner away from the trench being dug.

DESCRIPTION OF THE DRAWINGS

FIG. 1 is a diagrammatic side elevational view of a high-speed trenching machine preparing a trench beside a highway;

FIG. 2 is a fragmentary sectional, partially diagrammatic view, of a vertical section through the trench being dug and the associated parts of the trencher; and FIG. 3 is a broken, fragmentary sectional view in perspective, of the trench and associated parts of the trenching machine with which this invention is involved.

DESCRIPTION OF THE PREFERRED EMBODIMENT

The environs of use of this invention concerns tiling beside an existing interstate highway having concrete slab generally of at least two lanes width with a shoulder or berm extending at least a lane width on either side of the concrete slab. The trench for drainage tiling is dug through the asphalted shoulder beside the concrete slab since rainwater is known to enter and flow downwardly between the side of the concrete slab and the shoulder material. The drainage tiling so installed in 30 inch deep trenches, for example, will be provided with lateral connections every 300 or so feet to a ditch.

It is important to be able to install such drainage tiling at high speed in order to lower the cost of so doing. High-speed trenching machines, generally are much faster than bucket machines or backhoes, but have the disadvantage of cutting loose soil and throwing the same quite some distances. Ordinarily, the soil removed at the trench mouth is conveyed to either side by rotary screw conveyors so that the dirt reposes substantially beside the trench. A great amount of additional removed soil may be thrown on the highway and shoulder to be removed eventually by subsequent rainstorms.

Referring to FIG. 1, the present trenching machine 10 is equipped with a high horsepower motor driving continuous tracks 11, one of which will run upon the pavement of the highway when the machine is digging a trench beside the highway. Hydraulic cylinders 12 and 13, in banks, control the attitude of a boom 14 supporting therein a driven chain equipped with ground or earth cutters. A drive shaft 15 in a supporting boom 16 drives through universal joints, a chain drive sprocket about a center 17 on the boom with the chain and boom extending downwardly and rearwardly from the center 17.

In FIG. 1, the pavement surface 18 has a sloping asphalted shoulder 19 extending to the side of the pavement. The present machine is intended to remove soil and deposit the same in a row 20 remote from the ditch being formed by the high-speed machine.

While a chain trencher ordinarily throws material, particularly if the material is dry, some distances ahead of the high-speed chain cutters, the present invention provides for enclosing the boom and the forward cutting portion of the chain supported by the boom. A shroud wall 21 on each upper side of the boom encloses the upper portion of the boom. A shroud wall 22 encloses portions of the boom closer to the ground level. The shroud has a wall 23 extending between the side walls 22. All the shroud walls provide an enlarged space upwardly and forwardly of the cutting portion of the chain. The walls 22 closer to ground are not as far apart as the upper walls 21. This space within the shroud traps the propelled loose soil from the chain where it is collected for subsequent delivery to the side of the trenching operation. Preferably, the shroud may be made of sheet metal attached to framework secured to the boom of the trencher. Also, preferably, the sheet metal panels should be removable in the event that large stones, reinforcing rods or the like may be thrown into the shrouded space and interfere with further trenching operations.

Referring to FIGS. 2 and 3, the chain 24 supports a number of cutters 25 (diagrammatically shown) moving in the direction of arrow 26. The trench 27 is shown in one-half section, the earth 28 ahead of the trencher is present and yet to be pierced and dug by the chain cutters. As the cutters break through the soil and loosen a portion of it, that part loosened is propelled upwardly out of the earth with considerable force and considerable speed. The shroud provides a means for gathering the propelled soil except for that which would exit at the ground surface. In the present invention, means are provided for, in effect, extending the trench above ground so that a substantial amount, practically all of the removed soil, may be collected within the shroud and subequently conveyed to the lateral row 20.

Herein, the means for accomplishing the collection of the removed soil includes a belt conveyor 30 having a driven belt 31 driven by hydraulic motor 32 powered from the hydraulics of the trenching machine, in order to transport material which may fall upon the belt to the side row 20. In order to elevate substantially all of the soil to a position above the belt conveyor 30, including that soil immediately removed at the ground level, a temporary extension of the trench is provided. Each shroud side plate 22 is equipped with an auxiliary side plate 33 having a lower edge 34 to ride upon in a sliding fashion, either the pavement or the shoulder surface. The plate may be suitably equipped with braces 35 and may be mounted upon one or more vertical rods 36 with spring pressure so positioned as to urge the plate in a downward direction into engagement with the ground beside the trench. The rearward portion 38 of the plates are angled inwardly so as to provide a ramp for any soil deposited upon ground level, such as 39 beside the trench 27, in order to scrape that dirt back into the trench for subsequent removal by the moving chain cutters. In order to elevate dirt and remove soil into the shroud above the belt conveyor which must be above ground level, the side plates 33 are, in effect, connected by a flap 40 of flexible material having its upper portion 41 connected to the side of the belt conveyor 30 and its lower portion 42 dragging in sliding engagement with the surface of the highway shoulder immediately ahead of the advancing portion **27*a* of the trench. The trailing rear edge of lower portion 42 is closely spaced just out of contact with the cutters 25 on the chain. The side edges of the flap engage the side plates 33** although movable thereagainst. A rubberized fabric material as used in material conveying belts is satisfactory for use in making the flap.

The use of the side plates or baffles and the flexible flap provides a ramp for receiving and retaining a body or mass 43 of removed loose soil substantially as shown in FIG. 2. The soil immediately in front of the flap forms the mass 43, in effect, presenting an extension of the trench along the face 44 which is above ground level G. Removed soil, once the mass 43 is in place between the side plates and upon the flap, travels up over the face 44 and is propelled upwardly into the shroud 21, from whence it can fall by gravity onto the belt forming a deposit 45 thereon for subsequent deposit into the lateral row 20. The shrouds are cut away along the line 46 to provide an opening 47 over the belt conveyor for ready egress of the collected soil to the side row. An auxiliary curved plate **47*a*** may be placed on the backside of the belt conveyor structure in order to guide falling soil onto the belt thereof.

High-speed chain conveyors are capable of cutting trenches at much higher speed than other equipment. The present machine can move at forward speed of 2¾ mph and, if soil conditions permit, the trench may be formed at that pace. A 10 inch wide trench, from 30 inches deep to as much as 6 feet, can be formed. The trench may be governed in depth relative to the pavement through laser beam leveling electronic controlled hydraulics of the machine. In either event, once the trench is started and the mass of soil built up on the flap and between the plates ahead of the trench front face, soil thereafter removed can be propelled into the shroud and substantially completely collected for deposition in the windrow away from the trench, leaving the trench free of loose material and the ground surface G on either side of the trench also free of loose material. Drainage tiling installation may follow the trenching machine by several feet, or several hundred feet, and the sand compaction units may follow the installation of the drainage tiling without getting loose soil in the trench to disturb the proper orientation of the tile itself for drainage purposes or getting loose soil in the sand fill over the drainage tiling. Once the machine is stopped, there is only left a few cubic feet of soil, perhaps as little as 2 or no more than 4, to be removed from the trench site, that soil being only the mass 43 which remains on the flap and between the side plates once the chain digging operation is stopped.

We claim:

1. In a high-speed digging chain trencher, apparatus for trenching beside paved highway slab while leaving a clean trench for reception of drainage tubing overlaid with compacted sand fill free of loose soil, comprising:

a boom on the trencher having means carrying a drive chain with cutters for high speed cutting and opening of an earthen trench, said chain cutters piercing the soil and propelling loosened soil upwardly, sheet metal shrouds having side walls and an end wall joining the side walls enclosing said boom and chain portion above ground level when said boom and chain is in its dug trench, said side and end walls providing an enlarged enclosed space upwardly and forwardly of the cutting portion of the chain to catch propelled earth from the cutting chain, a lateral conveyor mounted in said shrouds at the lower end of said end wall above ground level and forward of the chain cutters relative to advancing direction and having a driven belt extending laterally to the side of said boom outside said shroud, said shroud side walls each terminating above the conveyor providing an opening above the belt to pass soil thereon out of the shroud, said end wall having an auxiliary soil deflecting plate connecting the end wall to the upper portion of the conveyor to deflect falling soil onto the conveyor, a pair of ground engaging upright plates, one carried by the shroud side plates on either side of the boom and trench and extending from the conveyor rearwardly beside the drive chain cutters, each plate having an inner surface positioned beside the chain cutter boom for deflection of trencher dug soil back into the trench as the trencher advances, a rubberized fabric flexible flap having an upper end secured to the upper portion of the lateral conveyor and a trailing body extending downwardly for dragging upon the ground with a rear edge closely adjacent said chain cutters, said flap having lateral edges movably engaging said upright plates to enclose the space immediately above and in advance of the chain cutters up to said lateral conveyor, whereby the trench is provided with a temporary extension above ground level by building up earth upon said flap between said upright plates permitting removed earth to be elevated to the conveyor for lateral movement away from the trench.

2. Apparatus as specified in claim 1 wherein said ground engaging upright plates beside the boom and chain are mounted upon upright rods secured to the side shroud plates for limited upright movement relative to said side plates and resilient means acting between said side shroud plates and ground engaging plates urges said plates into ground engagement beside the advancing trenching cutters.

* * * * *